US005307532A

United States Patent [19]

Connell

[11] Patent Number: 5,307,532

[45] Date of Patent: May 3, 1994

[54] COMPOSITE PILLOW

[75] Inventor: Douglas G. Connell, Perth, Australia

[73] Assignee: Delford Nominees Pty Ltd., Australia

[21] Appl. No.: 965,930

[22] Filed: Oct. 23, 1992

[51] Int. Cl.[5] ..... A47C 20/02

[52] U.S. Cl. ..... 5/643; 5/636

[58] Field of Search ..... 5/636, 643, 645, 481, 5/622

[56] References Cited

U.S. PATENT DOCUMENTS

| | | | |
|---|---|---|---|
| 1,890,358 | 12/1932 | Barcalo | 5/636 |
| 3,757,364 | 9/1973 | Downing | 5/636 |
| 4,759,089 | 7/1988 | Fox | 5/636 |
| 4,850,065 | 7/1989 | Walpin | 5/636 |
| 5,016,303 | 5/1991 | Tanaka | 5/636 |

FOREIGN PATENT DOCUMENTS

| | | | |
|---|---|---|---|
| AUB75007 | 10/1991 | Australia . | |
| 2504795 | 11/1982 | France | 5/636 |
| 2144985 | 3/1985 | United Kingdom | 5/636 |

*Primary Examiner*—Flemming Saether

*Attorney, Agent, or Firm*—Eckert Seamans Cherin & Mellott

[57] ABSTRACT

A pillow of composite construction comprises a first mass of resilient material for conforming to the head and neck region of a human body resting thereon and providing a comfortable support thereto, and an underlying mass of resilient material having a greater density than the first block. The underlying mass is shaped to provide a reactionary force that provides a manipulative action on said head and neck region of the user.

5 Claims, 1 Drawing Sheet

COMPOSITE PILLOW

BACKGROUND OF THE INVENTION

This invention relates to a pillow, and more particularly to a pillow having a manipulative action on the head and neck region of the human body.

The various concepts used in the construction of other pillows currently available provide only passive support to the neck region or the head and neck region of the human body. Prior art pillows have various shapes and constructions and may support the neck region and/or the head region, but none provides a manipulative action on the head and neck region.

An object of this invention is to provide both a support action and a manipulative action for the head and neck region of the human Body.

SUMMARY OF THE INVENTION

Accordingly the present invention provides a pillow of composite construction comprising a first mass of resilient material for conforming to the head and neck region of a human body resting thereon and providing a comfortable support thereto, and an underlying mass of resilient material having a greater density than said first mass and being shaped to provide a reactionary force that provides a manipulative action on said head and neck region.

Preferably, the underlying mass is in the form of a generally wedge-shaped block with an inclined front surface. The reactionary force occurs in both the horizontal and vertical directions to provide firm support for the head and slight stretching or traction of the neck.

The pillow, which is of integral construction, can be made of any suitable resilient material, such as polyurethane foam, for example.

BRIEF DESCRIPTION OF THE DRAWINGS

The invention will now be described in more detail, by way of example only, with reference to the accompanying drawings, in which.

DESCRIPTION OF THE PREFERRED EMBODIMENTS

Figure 1:
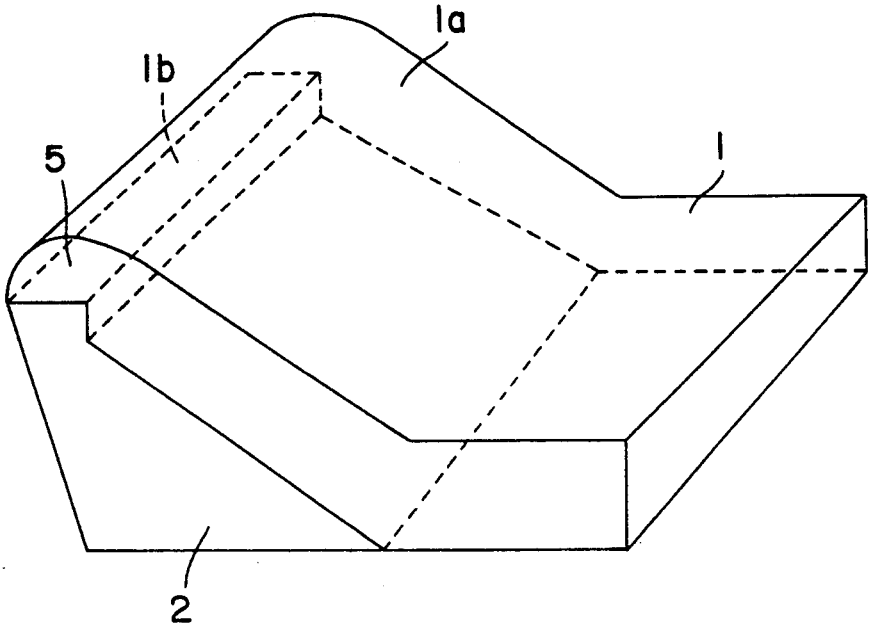
FIG. 1 is a perspective view of one embodiment of a pillow in accordance with the invention in the uncompressed state.

Referring to the drawings, the composite pillow comprises a first generally rectangular block 1 of polyurethane foam having a density of N-20-40 as per Australian Standard 2281 (1979) integrally formed on a second wedge-shaped block 2 of polyurethane foam having a density of N-28-100. The densities can be varied according to particular requirements, the important point being that the elasticities are different so that vertical compression of the pillow creates a horizontal reaction force away from the front of the pillow toward the head of the bed.

Front surface 3 of block 2 is inclined at an angle 20 of about 35° to the horizontal. The upper part 1*a* of block 1 forms a ramp extending up the inclined front surface of block 2. The front wall 4 of the block 2 is inclined slightly forward making an obtuse angle with the horizontal (angle 23=115°).

A rectangular ridge 5, including a generally vertical wall at the top of the front surface 3 of the block 2 mates with a corresponding recess in the overlapping portion 1*b* of the upper block 1.

Normally a conventional pillowcase of any suitable material will be placed over the pillow.

In use, face 21 is placed against the headboard of a bed, and front wall 4 faces the base of the bed. A person places his or her head 10 on the upper block 1, with the body to the left as shown in the drawings. The block 1 then conforms to the shape of the head and provides a comfortable and relaxing support. The curved lip 22 provides support for the neck 11. The weight of the head causes the pillow to compress (not shown) and the differential elasticity of the two blocks then provides the desired manipulative action since, due to the greater density of the lower block 2, a reactionary force to the weight of the head is generated in the vertical direction V and horizontal direction H. The horizontal force provides a slight stretching or fraction force on the neck tending to push it in the direction of the headboard of the bed away from the body. This manipulative action on the neck is of desirable therapeutic effect.

Important aspects of the invention therefore are:

a) The use of two blocks in the pillow construction;

b) The use of different but range-specific densities of the construction material; and c) The use of specific shapes for each section.

The densities and shapes of the two blocks can be tailored to provide the desired effect, i.e. the manipulative stretching action provided by the pillow to the head and neck region of the head and neck section of the human body.

The use of different densities in the two blocks of the pillow produces the desired effect. Block 1 is the manipulative blocks and is made of the most dense material. Block 2 is the comfort section and is the least dense material.

d) The overall cross-sectional shape illustrated ensures an effective fit into the body contours as well as the desired effect.

The angle 23 is chosen to allow the user's shoulder region to fit into the pillow and still allow the pillow to contact the neck region of the head and neck section of the human body.

The angle 20 (the slope of the surface 3) is chosen to ensure the desired manipulative effect.

The height of the front wall 24 of blocks 2 should be sufficient to allow the density difference to have an effect and yet not cause user discomfort.

The width of the ridge 5 ensures comfort and is the initial support-giving section of the pillow.

The distance 26 is selected to allow for the density ranges in the density ratings.

The distance 27 allows the pillow to fit into the neck region of the user's body and also caters for the density ranges in the density ratings.

The slope of surface 1*a* causes the manipulative block 2 to have its desired effect.

The height of wall 21 allows for comfort but does not nullify the effect of block 2.

The embodiment illustrated is constructed of polyurethane foam having the following densities (density ratings used are as per Australian Standard 2281 1979); Density of section A is N-28-100; Density of block 1 is N-20-40.

The pillow has the following dimensions in the uncompressed state: angle 23 is approximately 115 degrees; angle 20 is approximately 35 degrees; the slope 28 is the same as the slope 29; distance cd is approximately 97 millimeters; distance df is approximately 52 millimeters; distance fg is approximately 20 millimeters; distance fe is approxiatmely 52 millimeters; distance km is approximately 68 millimeters; distance cm is approximately 370 millimeters; the width of the pillow (distance xy diagram 2) is approximately 450 millimeters. The preferred distance range in each case is ±5 mm and the preferred angle range ±5°.

By compressing the pillow in the critical region (region above block 2), a resultant reactionary force is created due to the density differences between blocks 1 and 2. This force has a horizontal component (the desired manipulative or traction effect on the neck) and a vertical component (the support component).

By varying the density rating of the block 2 the desired manipulative effect can be increased or decreased; by varying the density rating of block 1, the comfort or feel of the pillow can be altered.

The pillowcase enclosing the contents of the pillow may be made from any material considered suitable.

The weight, dimensions and shape of the pillow may be varied to suit individual requirements.

In this specification, the term "elasticity" is defined in terms of the force the material exerts as it attempts to return to its original shape before distortion, or in other words the appropriate modulus of elasticity.

I claim:

1. A pillow of composite construction for supporting the head and neck region of a human body and providing active traction thereto, the pillow having a front and a rear; the pillow comprising:

an underlying block of material of a first resilience, said underlying block generally having a wedge shape including an inclined surface extending downward in the front to rear direction at an angle;

an overlying block of material of a second resilience disposed overlying said underlying block, the overlying block providing a comfortable support for a head and neck resting thereon and having a front rounded portion providing a neck supporting surface and a rear ramp surface sloping downwardly to the rear at an angle and generally parallel to the inclined surface of said underlying block below said ramp surface;

the underlying and overlying blocks of the respective first and second resilience cooperatively defining a resilience differential whereby the resilience differential and the configuration of the two blocks responds to a downward compression caused by the weight of a head and neck resting on the pillow by creating a reactionary force at least in a horizontal direction away from the front of the pillow, said reactionary force thereby providing traction to the head and neck region the underlying block has a protruding ridge at a top of its inclined surface defined by a generally vertical wall extending upwardly from said inclined surface.

2. A pillow as claimed in claim 1, wherein the underlying block has a front wall making an obtuse angle with a base thereof so that the front wall has a slight forward inclination.

3. A pillow as claimed in claim 2, wherein said obtuse angle is about 115°.

4. A pillow as claimed in claim 1, wherein said overlying block and said underlying block are made of polyurethane foam, the overlying block having a density of N-20-40 and the underlying block having a density of N-28-100.

5. A pillow as in claim 1 wherein the inclination of said inclined surface is about 35°.

* * * * *

UNITED STATES PATENT AND TRADEMARK OFFICE

CERTIFICATE OF CORRECTION

PATENT NO. : 5,307,532

DATED : May 3, 1994

INVENTOR(S) : Douglas G. Connell

It is certified that error appears in the above-indentified patent and that said Letters Patent is hereby corrected as shown below:

On the title page, item [54], and in column 1, line 1, delete the title "COMPOSITE PILLOW" and replace with --COMPOSITE PILLOW WITH BLOCKS OF DIFFERENT DENSITY CREATING ACTIVE TRACTION--.

Column 2, line 36, replace "blocks" with --block--.

Column 2, line 65, replace "section A" with --block 2--.

Column 3, lines 2-8, delete "distance cd is approximately ... is approximately 450 millimeters." and replace with --the height of the front wall 24 is approximately 97 millimeters; the front-to-back span of rectangular ridge 5 (i.e., left to right in FIG. 2) is approximately 52 millimeters; distance 26 is approximately 20 millimeters; distance 27 is approximately is approximately 52 millimeters; distance 21 is approximately 68 millimeters; the front-to-back span of the bottom of the combined blocks 1 and 2 (i.e., left

UNITED STATES PATENT AND TRADEMARK OFFICE

CERTIFICATE OF CORRECTION

PATENT NO. : 5,307,532

DATED : May 3, 1994

INVENTOR(S) : Douglas G. Connell

Figure 2:
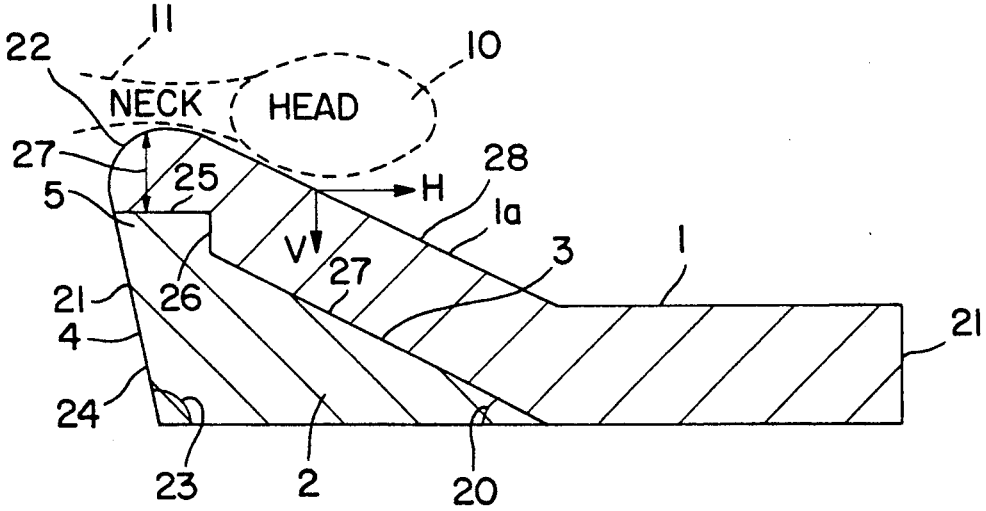
FIG. 2 is a cross-sectional view of the pillow shown in FIG. 1.

It is certified that error appears in the above-indentified patent and that said Letters Patent is hereby corrected as shown below:

to right in FIG. 2) is approximately 370 millimeters; the width of the pillow between left and right sidewalls (i.e., lower left to upper right in FIG. 1) is approximately 450 millimeters.--

Column 4, line 21, insert --;-- after "region" and begin a new paragraph with -"the underlying ...".

Signed and Sealed this

Twentieth Day of September, 1994

*Attest:*

Bruce Lehman

BRUCE LEHMAN

*Attesting Officer*

*Commissioner of Patents and Trademarks*